US008764258B2

(12) United States Patent
Watanabe et al.

(10) Patent No.: US 8,764,258 B2
(45) Date of Patent: Jul. 1, 2014

(54) INNER LENS FOR VEHICLE LIGHT AND VEHICLE LIGHT INCLUDING THE SAME

(71) Applicant: Stanley Electric Co., Ltd., Tokyo (JP)

(72) Inventors: Naoki Watanabe, Tokyo (JP); Hiroshi Miura, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 84 days.

(21) Appl. No.: 13/631,952

(22) Filed: Sep. 29, 2012

(65) Prior Publication Data

US 2013/0083551 A1 Apr. 4, 2013

(30) Foreign Application Priority Data

Sep. 30, 2011 (JP) ..... 2011-217083

(51) Int. Cl.
*F21V 7/00* (2006.01)
*F21S 8/10* (2006.01)

(52) U.S. Cl.
CPC ..... *F21S 48/22* (2013.01)
USPC ..... 362/516; 362/520; 362/522; 362/507

(58) Field of Classification Search
CPC ..... F21S 48/22
USPC ..... 362/507, 51, 520, 521, 522
See application file for complete search history.

(56) References Cited

U.S. PATENT DOCUMENTS

| | | | | |
|---|---|---|---|---|
| 5,081,564 | A * | 1/1992 | Mizoguchi et al. | 362/521 |
| 6,558,032 | B2 * | 5/2003 | Kondo et al. | 362/516 |
| 7,055,998 | B2 * | 6/2006 | Mochizuki | 362/518 |
| 2003/0227781 | A1 * | 12/2003 | Mochizuki | 362/517 |
| 2013/0063961 | A1 * | 3/2013 | Yamazaki et al. | 362/521 |

FOREIGN PATENT DOCUMENTS

JP 2008-293795 A 12/2008

* cited by examiner

*Primary Examiner* — Ali Alavi
(74) *Attorney, Agent, or Firm* — Kenealy Vaidya LLP

(57) ABSTRACT

An inner lens for use in a vehicle light can be configured to sufficiently enhance aesthetic features, decorative features, unpredictable features, etc., without adversely affecting the formation of the main light distribution. The inner lens can include a main body portion having a main surface that faces towards the reflecting surface of the reflector, and a plurality of independent convex projections formed on the main surface of the main body portion at an area corresponding to the reflecting surface. The light emitted from the light source and that reaches the projections can enter the projections and the main body portion and then be reflected and/or refracted by the projections and the main body portion so as to be directed to a direction diagonally forward of the vehicle light as light that does not contribute to the formation of the main light distribution.

24 Claims, 7 Drawing Sheets

INNER LENS FOR VEHICLE LIGHT AND VEHICLE LIGHT INCLUDING THE SAME

This application claims the priority benefit under 35 U.S.C. §119 of Japanese Patent Application No. 2011-217083 filed on Sep. 30, 2011, which is hereby incorporated in its entirety by reference.

TECHNICAL FIELD

The presently disclosed subject matter relates to an inner lens which constitutes a portion of a vehicle light as well as a vehicle light including such an inner lens.

BACKGROUND ART

In general, a combination vehicle light can be referred to as a front-combination lamp or a rear-combination lamp, and can include a housing, an outer lens defining together with the housing a lamp chamber that can be divided into a plurality of areas by functions such as an illumination lamp, a display lamp, a position lamp, a signal lamp, etc., and light sources that are disposed in the respective areas. An inner lens can be typically disposed in between the light sources and the outer lens.

Common outer lenses may be formed from a plain lens that is not subjected to lens-cut for light-path control and can be transparent and without color. In this case, an inner lens can have a function for concealing unattractive portions without aesthetic appearance when a viewer observes the vehicle lamp through the plain outer lens.

The inner lens may also have a function for forming a desired light distribution pattern alone or together with a reflector so as to control light paths of light emitted from the light source(s).

Further, the inner lens may have a function of color filter in order to impart desired colors to light beams from respective areas divided by functions. In this case, the inner lens can have respective colored areas corresponding to the desired colors.

Any of or all of these functions possessed by such an inner lens can be incorporated in the combination vehicle light, and further there is a demand to impart aesthetic features, decorative features, unpredictable features, etc., to a combination vehicle light in order to enhance the attractiveness of the lamp.

In response to this demand, a vehicle light 80 in which additional values other than the structural function is given to an inner lens has been proposed as shown in FIG. 1.

Such a vehicle light 80 can include an inner lens 84 having a lens portion 81, a side wall portion 82, and a flange portion 83, a housing defining together with the inner lens 84 a lamp chamber 86, and a light source disposed inside the lamp chamber 86. The vehicle light can include a light source 87 configured as an illumination light source that emits light beams including light beams L1 directed to the lens portion 81 and light beams L2 directed to a parabolic reflecting surface 88 of the housing 85. Light beams L3 emitted from the light source 87 and directed toward the side wall portion 82 can be allowed to pass through the side wall portion 82 toward the flange portion 89 having lens cuts 89*a*, 89*b* configured to reflect/refract the light beams by the lens cuts 89*a*, 89*b*, thereby achieving decorative effects and/or impact effects. (See Japanese Patent Application Laid-Open No. 2008-293795, for example.)

In this vehicle light 80, the lens cuts 89*a*, 89*b* aiming to impart the decorative effects and/or impact effects to the inner lens 84 can be provided to the flange portion 83 extending in a ring shape perpendicular to the side wall portion 82 from the outer peripheral portion 90 of the lens portion 81. The lens portion 81 positioned in a transparent area for allowing light beams to pass to form a main light distribution of the vehicle light 80 does not have lens cuts at the center portion of the inner lens 84.

Accordingly, such partial lens cuts 89*a*, 89*b* of the inner lens 84 may not sufficiently provide the decorative effects and/or impact effects.

SUMMARY

The presently disclosed subject matter was devised in view of these and other problems and features in association with the conventional art. According to an aspect of the presently disclosed subject matter, an inner lens for use in a vehicle light can sufficiently enhance its added value such as aesthetic features, decorative features, unpredictable features, etc., without adversely affecting the formation of the main light distribution.

According to another aspect of the presently disclosed subject matter, an inner lens can be used in a vehicle light having a light source, a reflector that reflects light from the light source by its reflecting surface, the transparent inner lens and a transparent outer lens for allowing the reflected light to pass therethrough to be projected forward with a prescribed main light distribution in front of the vehicle light. The inner lens can have a main body portion of which a main surface faces to the reflecting surface of the reflector, and a plurality of independent convex projections formed on the main surface of the main body portion at an area corresponding to the reflecting surface. The inner lens is configured such that the light emitted from the light source and reaching the projections can be allowed to enter the projections and the main body portion and then be reflected and/or refracted by the projections and the main body portion so as to be directed to a direction diagonally forward of the vehicle light as light for not contributing to the formation of the main light distribution.

In the inner lens for a vehicle light according to the above aspect, a ratio of the total area of the projections occupying the main surface of the main body portion to the area of the main surface of the main body portion can be 5% or smaller.

In the inner lens for a vehicle light according to any of the above aspects, the projections can be disposed radially and concentrically about a center axis of the main body portion of the inner lens at equal angular intervals.

In the inner lens for a vehicle light according to any of the above aspects, the projections can each have a shape produced by cutting a conical body having an axis by a plane parallel to the axis of the conical body so that a cut surface is placed on the main surface and a bottom of the cut conical body is a plane erected upright from the main surface of the main body. In this configuration, the projections can be configured such that the erected plane has a partial circle with a radius of 0.8 mm and a width of 1.5 mm at its base end.

In the inner lens for a vehicle light according to the above aspect, the projections can be disposed so that the erected planes of the projections are directed to the center axis of the main body portion of the inner lens.

According to another aspect of the presently disclosed subject matter, a vehicle light can have an inner lens with any of the above configurations.

With this configuration described as above, the inner lens can be used in a vehicle light in which light emitted from a light source and reflected by a reflector for light path control can enter a transparent inner lens and a transparent out lens that do not contribute for the formation of light distribution and be allowed to pass therethrough to be projected forward with a prescribed main light distribution in front of the vehicle light. Provided on the main surface of the main body portion of the inner lens are a plurality of independent convex projections at an area corresponding to the reflecting surface. Furthermore, the inner lens is configured such that the light having passed through the projections and the main body portion can be directed to a direction diagonally forward of the vehicle light as light for not contributing to the formation of the main light distribution.

The projections can diffuse the light that does not adversely affect the formation of the light distribution but can be seen as if scattered jewels or stars in the sky are shining, thereby enhancing sufficiently the added values such as aesthetic features, decorative features, unpredictable features, etc.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

Figure 1:
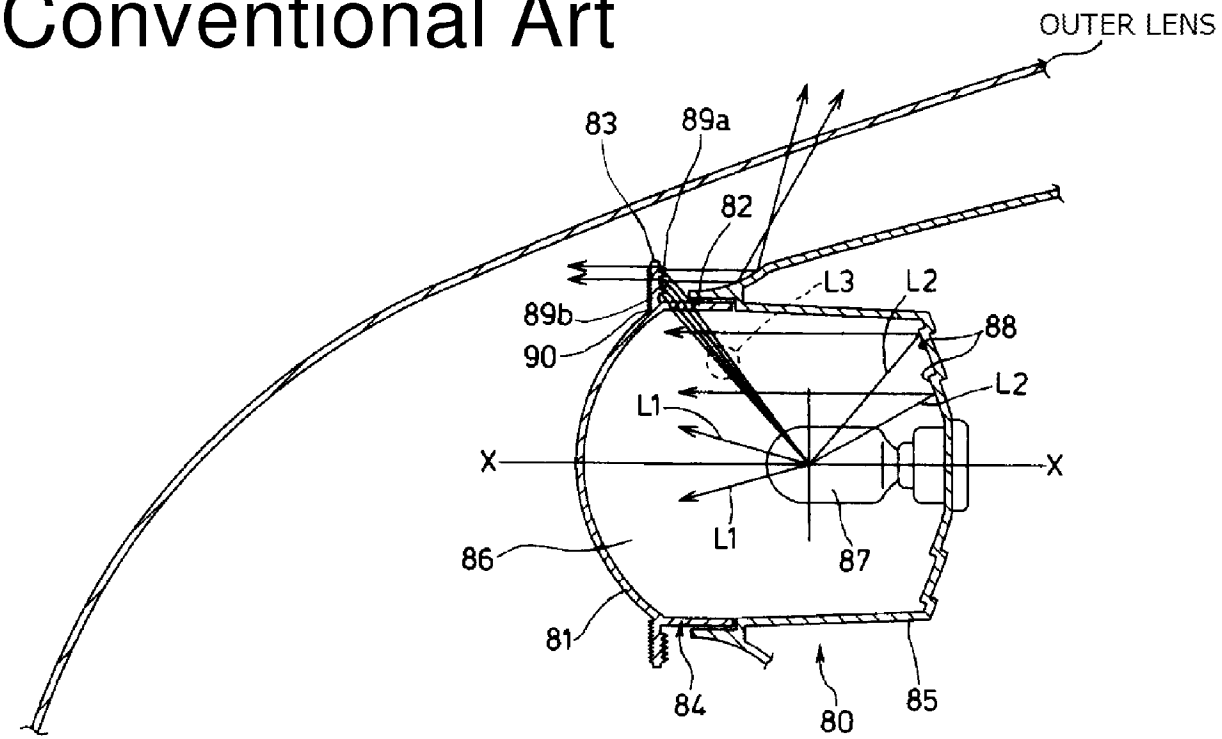
Fig. 1 Conventional Art
FIG. 1 is a cross-sectional view illustrating a conventional vehicle light.

A description will now be made below to vehicle lights of the presently disclosed subject matter with reference to the accompanying drawings in accordance with exemplary embodiments. In the drawings, same or similar components are denoted by the same number.

Figure 2:
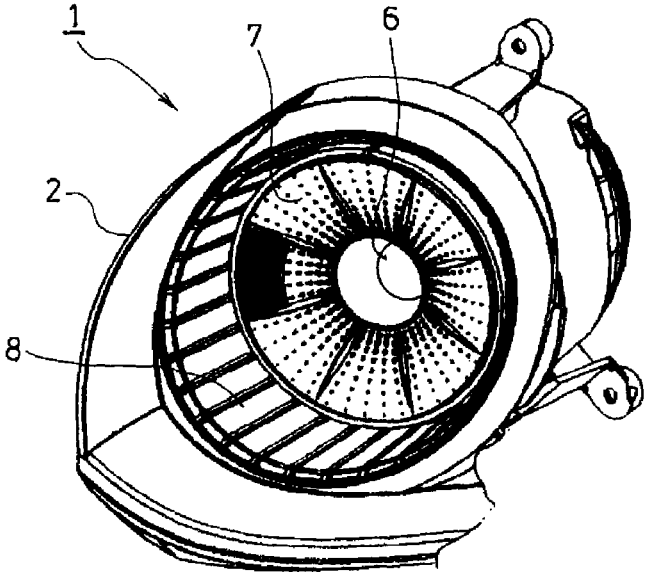
FIG. 2 is a perspective view illustrating an example of a vehicle light to which an inner lens made in accordance with principles of the presently disclosed subject matter can be applied.
Figure 3:
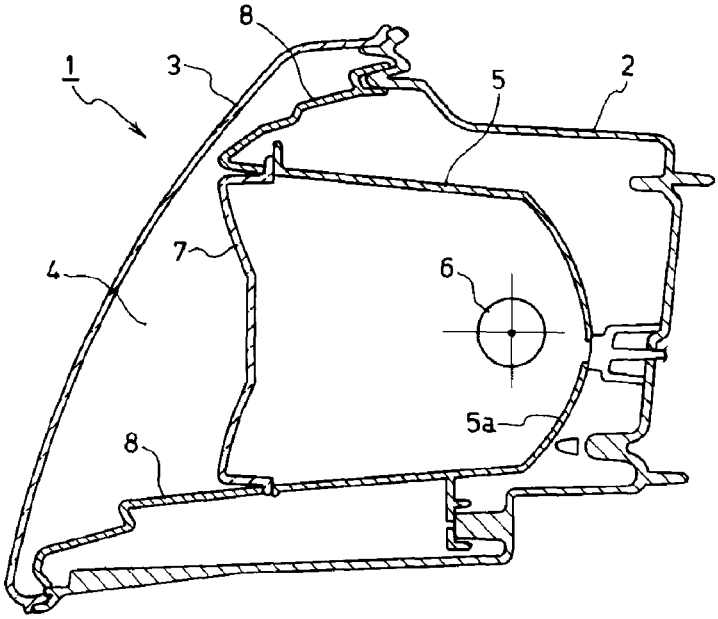
FIG. 3 is a longitudinal cross-sectional view illustrating the vehicle light of FIG. 2.

FIGS. 2 and 3 show one example of a vehicle light to which an inner lens made in accordance with principles of the presently disclosed subject matter can be applied. In particular, FIG. 2 is a perspective view illustrating a vehicle light from which an outer lens has been removed, and FIG. 3 is a longitudinal cross-sectional view illustrating the vehicle light of FIG. 2.

In the drawings, reference numeral 1 denotes the vehicle light, 2 denotes a housing, 3 denotes an outer lens, 5 denotes a reflector, 6 denotes a light source, 7 denotes an inner lens, and 8 denotes an extension.

The housing 2 can have an opening at one end, which is covered with the transparent outer lens 3 attached to the housing 2, thereby defining a lamp chamber 4.

In the lamp chamber 4, the reflector 5 can be fixed and supported by the housing 2 so that the opening of the reflector 5 can be directed to the outer lens 3. Herein, the inner surface can serve as a concave reflecting surface 5*a*. Inside the reflector 5, the light source 6 can be installed so that the light source 6 is surrounded by the convex reflecting surface 5*a* of the reflector 5 at its side and at an obliquely rear side.

The inner lens 7 can be attached to the reflector 5 so as to cover the opening of the reflector 5. The inner lens 7 will be described in detail later.

The extension 8 can be subjected to bright finishing by aluminum deposition or chrome plating as well as to knurling for light diffusion. The resulting extension 8 can shield the gap between the housing 8 and the reflector 5 and also impart an aesthetic appearance to the light.

A description will now be given of the inner lens 7 with reference to FIGS. 4 to 9.

Figure 4:
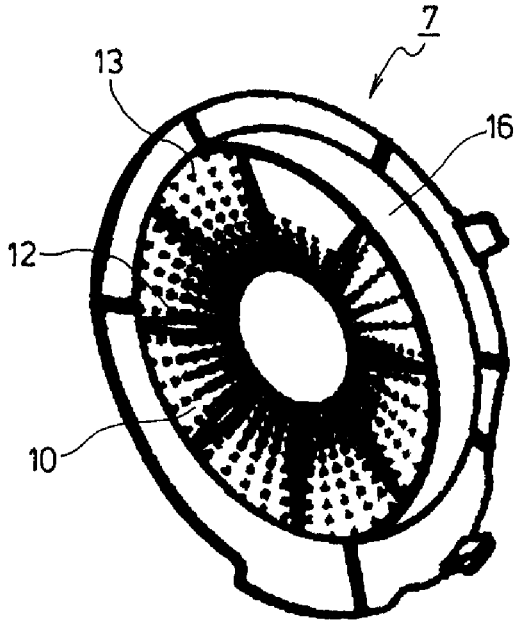
FIG. 4 is a perspective view illustrating the inner lens used in the vehicle light of FIG. 2

As shown in FIG. 4 (perspective view), the inner lens 7 can be a transparent lens having a main body portion 16 formed from a transparent material. Thus, the inner lens 7 may not contribute to the formation of the light distribution of the vehicle light. It should be noted that the inner lens 7 may be provided with lens cuts for decorative purpose to improve the aesthetic appearance within the range where the formation of the light distribution is not impaired.

In the present exemplary embodiment, the main body portion 16 of the inner lens 7 can have a first surface 10 closer to the outer lens 3 and a second surface 11 closer to the light source 6 (or closer to the reflecting surface 5*a* of the reflector 5). The first surface 10 may be called a light exit surface where the light emitted from the light source 6 and which passes through the main body portion 16 of the inner lens 7 can exit from that surface, and can be provided with a plurality of decorative lines 12 that extend radially. The second surface 11 may be called a light incident surface on which the light emitted from the light source 6 can be incident, and can be provided with a plurality of small independent projections 13 within the range where the formation of the light distribution is not impaired. As a matter of course the decorative lines 12 do not impair the formation of the light distribution.

Figure 5:
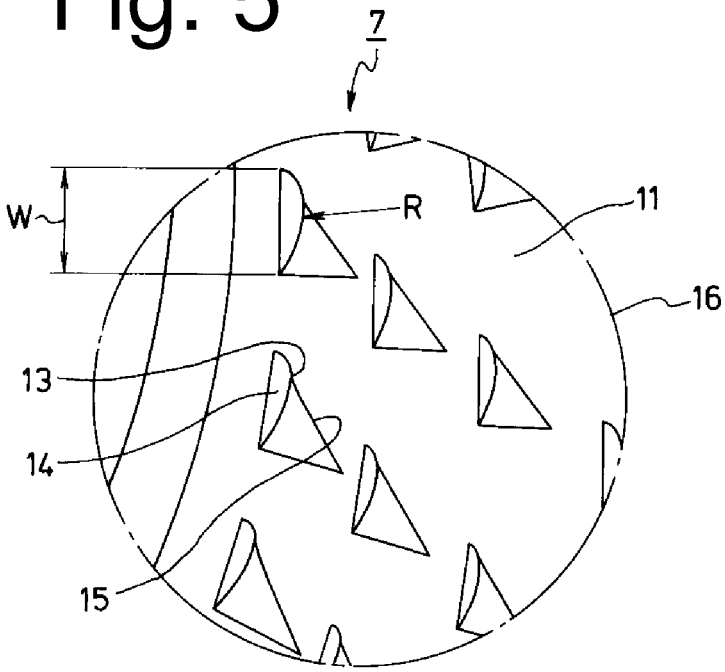
FIG. 5 is an enlarged perspective view illustrating part of the inner lens of FIG. 4.

As shown in FIG. 5, which illustrates the enlarged partial perspective view of the light incident surface 11 of the inner lens, each projection 13 can have a shape produced by cutting a conical body having an axis (for example a longitudinal axis, or axis that extends from the point of the conical body to a central area of a surface opposed to the point) by a plane parallel to the axis of the conical body. The projections can be disposed on the second surface 11 of the main body portion 16 of the inner lens 7 at an area corresponding (facing) to the reflecting surface 5*a* so that the cut surfaces of the respective projections are directed to and placed on the second surface 11.

In this configuration, the projections 13 placed on the light incident surface 11 of the main body portion 16 of the inner lens 7 can be configured such that an erected plane 14 corresponding to the bottom of the cut conical body can be substantially perpendicular to the light incident surface 11 and provide a partial circle with a radius R of 0.8 mm and a width of 1.5 mm at its base end.

Further, the projections can each have a curved side face derived from the conical body and inclined with respect to the light incident surface 11 (which will be referred to as an inclined curved surface). Therefore, the projections can be a triangle when viewed from above.

Figure 6:
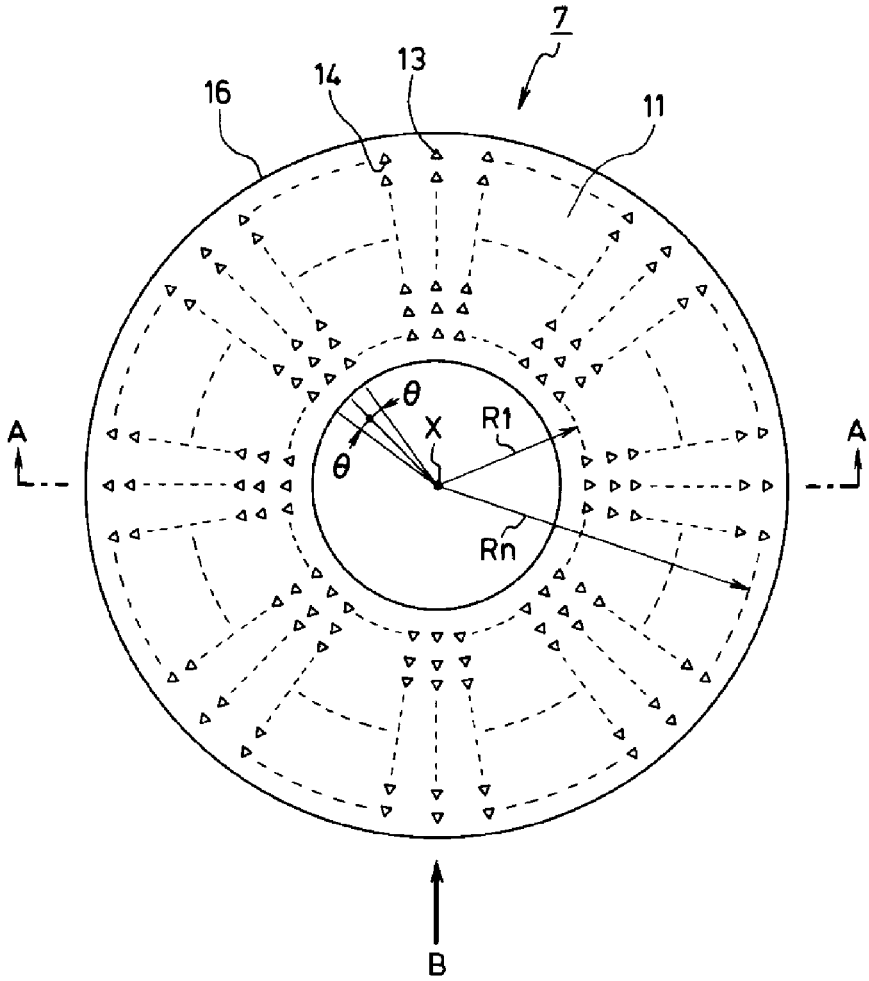
FIG. 6 is a front view illustrating the arrangement of the projections of the inner lens of FIG. 2.

FIG. 6 is a front view of the main body portion 16 of the inner lens 7 when viewed from the light incident surface side, illustrating the arrangement of the projections 13 with the above shape on the light incident surface 11 of the inner lens 7.

The projections can be arranged on concentric circles R1 to Rn and disposed radially about a center axis X of the main body portion 16 of the inner lens 7 at equal angular intervals θ. Every erected plane 14 can be directed to the center axis X of the main body portion 16 of the inner lens 7. Specifically, the projection 13 can be a cut piece that can be prepared by cutting a conical body having an axis by a plane parallel to the axis of the conical body, and the cut pieces thus obtained are concentrically and radially arranged on the light incident surface 11 around the center axis X of the main body portion 16 of the inner lens 17 so that the erected plane 14 corresponding to the bottom of the cut conical body is directed (faces) to the center axis X of the main body portion 16 of the inner lens 17.

Figure 7:
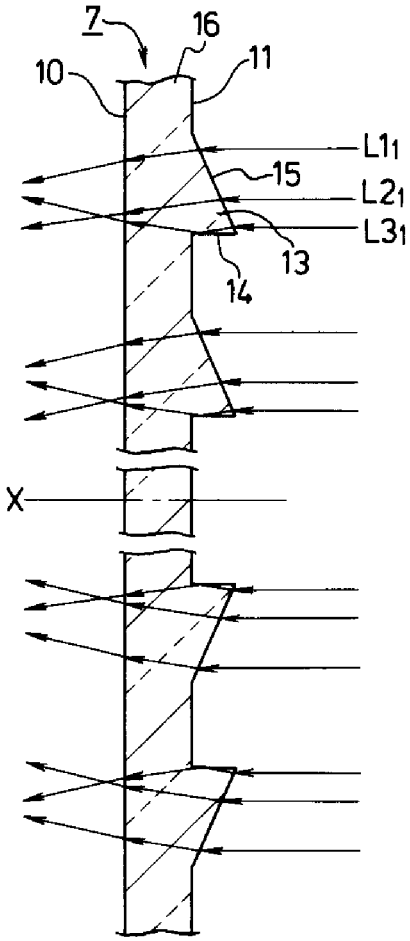
FIG. 7 is an enlarged cross-sectional view of part of the inner lens taken along line A-A in FIG. 6, illustrating how to control the light paths.

A description will next be given of the optical function of the projection 13 with reference to FIG. 7, which is a cross-sectional view of the inner lens 7 taken along line A-A in FIG. 6, and with reference to FIG. 8, which is a partial enlarged view of the inner lens 7 when viewed from the arrow B in FIG. 6.

In the vehicle light according to the present exemplary embodiment, both the inner lens 7 and the outer lens 3 can be a transparent lens that does not significantly contribute to the formation of the light distribution, which can be achieved mainly by the inner concave reflecting surface 5*a* of the reflector 5. Therefore, the light emitted from the light source 6 can be reflected by the concave reflecting surface 5*a* of the reflector 5 so that its optical path is controlled, and then the reflected light can be projected in a prescribed direction to thereby form a desired light distribution pattern of light. (See FIG. 3.)

In this case, the distance from the light source 6 to the inner lens 7 may be very short in comparison with the distance from the light source 6 to the object to be illuminated or to be observed in front of the vehicle light 1. Therefore, the light emitted from the light source 6 and reflected by the convex reflecting surface 5*a* of the reflector 5 so that its optical path is controlled and having reached the inner lens 7 can be considered to be substantially parallel light.

The substantially parallel light thus controlled can be incident on the respective projections 13, so that the inclined curved surface 15 of the projection 13 is illuminated with the light. FIG. 7 is an enlarged cross-sectional view of part of the inner lens 7 cut along a plane perpendicular to the light incident surface 11 (or the light exit surface 10). A light beam $L1_1$ incident on the inclined curved surface 15 at the farthest position from the erected plane 14 and a light beam $L2_1$ incident on the inclined curved surface 15 at the middle position thereof can enter the projection 13 while being refracted by the inclined curved surface 15 and guided through the projection 13 and the main body portion 16, and then refracted by the light exit surface 10 to thereby be projected toward the center axis X direction of the main body portion 16 of the inner lens 7. Specifically, the light beam $L1_1$ and the light beam $L2_1$ can be subjected to optical-path control by the two-time refraction. (It should be noted that this exemplary embodiment is illustrated in the simplest manner, and accordingly, is described in the singular.)

On the other hand, a light beam $L3_1$ incident on the inclined curved surface 15 at the nearest position to the erected plane 14 can enter the projection 13 while being refracted by the inclined curved surface 15, and can then be guided through the projection 13 and totally reflected by the inner surface of the erected plane 14. The light beam $L3_1$ can further be guided through the main body portion 16, and then can be refracted by the light exit surface 10 to thereby be projected toward a direction away from the center axis X of the main body portion 16 of the inner lens 7. In this case, the light beam $L3_1$ can be subjected to optical-path control by the two-time refraction.

Specifically, in any of the above cases, the light beams $L1_1$, $L2_1$, and $L3_1$ passing through the projection 13 and the main body portion 16 of the inner lens 7 and projected from the light exit surface 10 can become diffused light beams projected in directions other than along the center axis X of the main body portion 16 of the inner lens 7.

Figure 8:
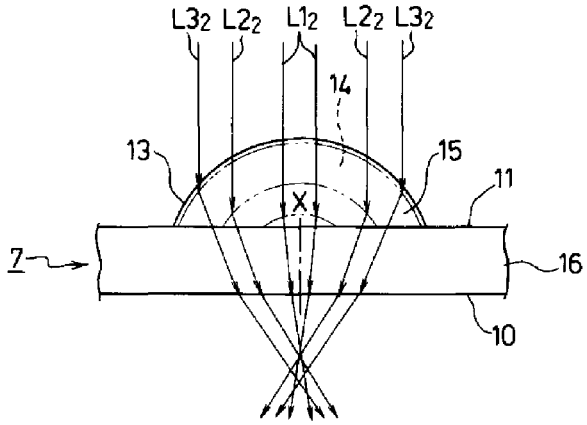
FIG. 8 is an enlarged view of the inner lens viewed from an arrow B in FIG. 5, illustrating how to control the light paths by the projection.

FIG. 8 is an enlarged view of the inner lens viewed from an arrow B in FIG. 5, illustrating how to control the light paths by the projection 13. As shown, a light beam $L1_2$ incident on the inclined curved surface 15 at the farthest position from the erected plane 14, a light beam $L2_2$ incident on the inclined curved surface 15 at the middle position thereof, and a light beam $L3_2$ incident on the inclined curved surface 15 at the nearest position to the erected plane 14 can enter the projection 13 and can be refracted by the inclined curved surface 15. The light beams $L1_2$, $L2_2$, and $L3_2$ passing through the projection 13 and the main body portion 16 of the inner lens 7 and being refracted by the light exit surface 10 can be projected toward the center axis X of the main body portion 16 of the inner lens 7. Specifically, the light beams $L1_2$, $L2_2$, and $L3_2$ can be subjected to optical-path control by the two-time refraction.

Specifically, in any of the above cases, the light beams $L1_2$, $L2_2$, and $L3_2$ passing through the projection 13 and the main body portion 16 of the inner lens 7 and being projected from the light exit surface 10 can become diffused light beams projected in different directions from the center axis X of the main body portion 16 of the inner lens 7.

Further, among the light beams incident on each projection 13 of the inner lens 7, the light beam incident on the inclined curved surface 15 at the farthest position from the erected plane 14 can be a combined light beam passing through a combined optical path of the optical path for the light beam $L1_1$ and the optical path for the light beam $L1_2$. The light beams incident on the inclined curved surface 15 at the middle position thereof can be a combined light beam passing through a combined optical path of the optical path for the light beam $L2_1$ and the optical path for the light beam $L2_2$. The light beams incident on the inclined curved surface 15 at the nearest position to the erected plane 14 can be a combined light beam passing through a combined optical path of the optical path for the light beam $L3_1$ and the optical path for the light beam $L3_2$.

With this configuration, almost all the combined light beams derived from the light beams incident on each projection 13 arranged on the main body portion 16 of the inner lens 7 can be diffused light beams directed in different directions from the center axis X of the main body portion 16 of the inner lens 7 by the refraction and reflection.

As shown in FIG. 8, which illustrates the optical path control within the main body portion 16 of the inner lens 7, the direction of the center axis X of the main body portion 16 of the inner lens 7 can be a direction in which the main light distribution should be formed with the vehicle light 1. Therefore, light beams La that pass through the main body portion 16 of the inner lens 7 other than the area where the projections 13 are arranged can form the main light distribution. In contrast thereto, light beams Lb that pass through the respective projections 13 can be directed in different direction from the center axis X in which the main light distribution should be formed with the vehicle light 1. As a result, the light beams Lb that can be controlled by the projections 13 provided on the light incident surface 11 (rear surface) of the inner lens 7 can be used for decorative purposes when a viewer observes the vehicle light 1 obliquely from above without adversely affecting the formation of the main light distribution. For example, the resulting light beams Lb can be observed as if the inner lens is floating up, thereby enhancing the sense of depth of the vehicle light.

Figure 9:
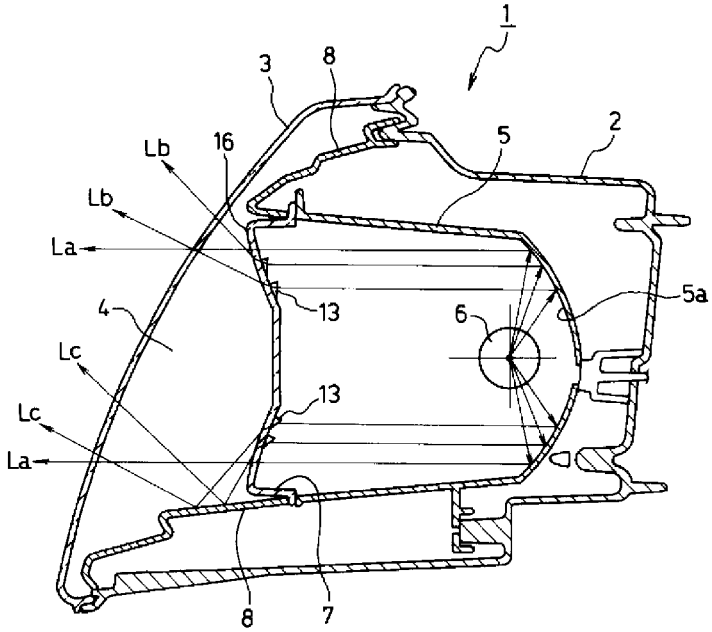
FIG. 9 is a longitudinal cross-sectional view of the inner lens of FIG. 2 illustrating how to control the light paths.

Some of the light beams Lb that have been controlled by the projections 13 may be directed toward the extension 8 as shown by light beams Lc in FIG. 9, and the light beams Lc can be further diffused by the extension 8. Such diffused light beams Lc can enhance the existence of the extension 8 which poses the aesthetic appearance.

As described above, the vehicle light 1 according to the present exemplary embodiment can be provided with a transparent inner lens that does not contribute to the formation of light distribution and has a plurality of projections on the light incident surface thereof. Due to this configuration, the projections can diffuse the light beams that do not adversely affect the formation of the light distribution but can be seen as if scattered jewels or stars in the sky are shining, thereby sufficiently enhancing the added values such as aesthetic features, decorative features, unpredictable features, etc.

It should be noted that, in order for the projections not to adversely affect the formation of the main light distribution, the ratio of the total area of the projections occupying the main surface (light incident surface) of the main body portion of the inner lens to the area of the main surface of the main body portion can be 5% or smaller. If the ratio of the total area of the projections exceeds 5%, the amount of light that contributes to the formation of the main light distribution may decrease significantly, whereby sufficient amount of light may not be ensured for satisfying various standards for the formation of light distribution.

When the ratio of the total area of the projections occupying the main surface (light incident surface) of the main body portion of the inner lens to the area of the main surface of the main body portion is controlled to be 5% or smaller, various standards for the formation of light distribution for vehicle lights can be satisfied while such a configuration can sufficiently enhance the added values such as aesthetic features, decorative features, unpredictable features, etc.

It should be appreciated that although the projections 13 are arranged radially and concentrically at equal angular intervals with respect to the center axis X of the inner lens 7, the arrangement is not limited to this particular arrangement and the projections can be arranged randomly or regularly in accordance with appropriate specifications or desires.

In one embodiment, the projections can be described as having a half-conical shape with a pointed end pointing directly away from the center axis of the lens such that a planar surface opposed to the pointed end is substantially perpendicular to a radial line extending from the center axis of the lens. In addition to the half-conical shape, the outer shape of the projection may be a half-polygonal pyramid shape including at least two inclined surface, such as a half-pyramid shape, a half-hexagonal pyramid shape, and the like. The shape of the planar surface can be a half circle, but can also be formed as a half oval, rectangle, non-symmetrical, or other shape depending on design applications. The outermost inclined curved surface 15 of the conical projections 13 can be defined by a geometric cone shape, but can also be varied in shape with certain undulations or turns and indents without departing from the spirit and scope of the disclosed subject matter. The conical projections 13 can extend outward from a substantially (almost or totally) planar surface that can constitute the main light distribution portion of the light incident surface 11.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. An inner lens for use in a vehicle light having a light source, a reflector that has a reflecting surface configured to reflect light from the light source by the reflecting surface, a transparent inner lens and a transparent outer lens configured to allow the reflected light to pass therethrough and to be projected forward with a prescribed main light distribution in front of the vehicle light, the inner lens comprising:

a main body portion having a main surface configured to face towards the reflecting surface of the reflector; and a plurality of independent convex projections formed on the main surface of the main body portion at an area corresponding to the reflecting surface, wherein light emitted from the light source during operation of the light source and which reaches the projections enters the projections and the main body portion and is then at least one of reflected and refracted by the projections so as to be directed to a direction diagonally forward of the vehicle light and forms light not contributing to formation of the main light distribution.

2. The inner lens according to claim 1, wherein a ratio of a total area of the projections occupying the main surface of the main body portion to an area of the main surface of the main body portion is 5% or smaller.

3. The inner lens according to claim 1, wherein the main body portion of the inner lens has a center axis, and the projections are disposed radially and concentrically about the center axis of the main body portion of the inner lens at equal angular intervals.

4. The inner lens according to claim 2, wherein the main body portion of the inner lens has a center axis, and the projections are disposed radially and concentrically about the center axis of the main body portion of the inner lens at equal angular intervals.

5. The inner lens according to claim 1, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

6. The inner lens according to claim 2, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

7. The inner lens according to claim 3, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

8. The inner lens according to claim 4, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

9. The inner lens according to claim 5, wherein the projections are disposed so that the erected planes of the projections are directed to the center axis of the main body portion of the inner lens.

10. The inner lens according to claim 6, wherein the projections are disposed so that the erected planes of the projections are directed to the center axis of the main body portion of the inner lens.

11. The inner lens according to claim 7, wherein the projections are disposed so that the erected planes of the projections are directed to the center axis of the main body portion of the inner lens.

12. The inner lens according to claim 8, wherein the projections are disposed so that the erected planes of the projections are directed to the center axis of the main body portion of the inner lens.

13. A vehicle light, comprising:

a light source;

a reflector having a reflecting surface configured to reflect light from the light source by the reflecting surface; and a transparent inner lens and a transparent outer lens configured to allow the reflected light to pass therethrough and to be projected forward with a prescribed main light distribution in front of the vehicle light, the inner lens comprising:

a main body portion having a main surface facing towards the reflecting surface of the reflector; and a plurality of independent convex projections formed on the main surface of the main body portion at an area corresponding to the reflecting surface, wherein light emitted from the light source during operation of the light source and which reaches the projections enters the projections and the main body portion and is at least one of reflected and refracted by the projections so as to be directed to a direction diagonally forward of the vehicle light and forms light not contributing to the main light distribution.

14. The vehicle light according to claim 13, wherein a ratio of a total area of the projections occupying the main surface of the main body portion to an area of the main surface of the main body portion is 5% or smaller.

15. The vehicle light according to claim 13, wherein the main body portion of the inner lens has a center axis, and the projections are disposed radially and concentrically about the center axis of the main body portion of the inner lens at equal angular intervals.

16. The vehicle light according to claim 14, wherein the main body portion of the inner lens has a center axis, and the projections are disposed radially and concentrically about the center axis of the main body portion of the inner lens at equal angular intervals.

17. The vehicle light according to claim 13, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

18. The vehicle light according to claim 14, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

19. The vehicle light according to claim 15, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

20. The vehicle light according to claim 16, wherein, the projections each have a shape produced by cutting a conical body having an axis by a plane parallel to the axis of the conical body so that a cut surface is placed on the main surface and a bottom of the cut conical body is a plane erected upright from the main surface of the main body, the erected plane having a partial circle with a radius of 0.8 mm and a width of 1.5 mm at a base end of the cut conical body.

21. The vehicle light according to claim 17, wherein the projections are disposed so that the erected planes of the projections are directed to the center axis of the main body portion of the inner lens.

22. The vehicle light according to claim 18, wherein the projections are disposed so that the erected planes of the projections are directed to the center axis of the main body portion of the inner lens.

23. The vehicle light according to claim 19, wherein the projections are disposed so that the erected planes of the projections are directed to the center axis of the main body portion of the inner lens.

24. The vehicle light according to claim 20, wherein the projections are disposed so that the erected planes of the projections are directed to the center axis of the main body portion of the inner lens.

* * * * *